US010889945B2

(12) United States Patent
Thiesse et al.

(10) Patent No.: US 10,889,945 B2
(45) Date of Patent: Jan. 12, 2021

(54) EMULSION HEATING CONTROL FOR A PAVING MACHINE

(71) Applicant: Caterpillar Paving Products Inc., Brooklyn Park, MN (US)

(72) Inventors: Chad M. Thiesse, Brooklyn Park, MN (US); Toby A. Frelich, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 163 days.

(21) Appl. No.: 16/156,652

(22) Filed: Oct. 10, 2018

(65) Prior Publication Data

US 2020/0115861 A1 Apr. 16, 2020

(51) Int. Cl.
*E01C 19/48* (2006.01)
*E01C 19/21* (2006.01)

(52) U.S. Cl.
CPC ..... *E01C 19/4873* (2013.01); *E01C 19/21* (2013.01); *E01C 2301/10* (2013.01)

(58) Field of Classification Search
CPC ..... E01C 19/4873; E01C 19/48; E01C 19/21; E01C 19/17; E01C 19/176; E01C 2301/10
See application file for complete search history.

(56) References Cited

U.S. PATENT DOCUMENTS 4,944,632 A * 7/1990 Dillingham ..... E01C 19/08 404/101
5,851,085 A * 12/1998 Campbell ..... E01C 19/174 404/75
8,297,875 B1 * 10/2012 Kopacz ..... E01C 19/48 404/118
10,260,208 B1 * 4/2019 Dillingham ..... E01C 23/10
2006/0212203 A1 * 9/2006 Furuno ..... G07C 5/085 701/50
2009/0257824 A1 * 10/2009 Musil ..... E01C 19/174 404/79
2013/0195550 A1 * 8/2013 Bertz ..... E01C 19/48 404/72
2013/0304338 A1 * 11/2013 Frelich ..... F16D 48/06 701/67

FOREIGN PATENT DOCUMENTS

CN 203420205 U 2/2014
DE 4101417 A1 10/1991

* cited by examiner

*Primary Examiner* — Abigail A Risic
(74) *Attorney, Agent, or Firm* — Bookoff McAndrews; Jeff A. Greene

(57) ABSTRACT

A paving machine includes an engine, a material conveying system, a screed system including a plurality of screed heaters, and an emulsion sprayer system. The emulsion sprayer system includes an emulsion tank and one or more emulsion heaters. The machine further includes an engine load sensing system and a control system. The control system being configured to receive information from the engine load sensing system indicative of a load on the engine, and limit the operation of the one or more emulsion heaters when the received information indicates the load on the engine is above a value.

16 Claims, 3 Drawing Sheets

EMULSION HEATING CONTROL FOR A PAVING MACHINE

TECHNICAL FIELD

The present disclosure relates generally to a paving machine, and more particularly, to emulsion heating control for a paving machine.

BACKGROUND

Paving machines normally receive their power from an on-board power source, such as an engine. As such, the engine powers most all of the systems of the paving machine by providing either mechanical power or electrical power by driving a generator. For instance, screed heaters may draw a large amount of electrical power from the machine's generator, therefore increasing the load on the engine of the paving machine. This may be in addition to other loads on the engine of the paving machine, such as loads from a material conveying system and a propulsion system.

The paving process often involves delivering (e.g., spraying) an emulsion fluid in the form of a pre-coating tack or other treatment fluid on the ground or road surface to aid in the bonding of the later-deposited bitumen/asphalt. The treatment fluid may be delivered to the ground surface via a sprayer system that includes one or more fluid lines and spray bars coupled to the paving machine. The treatment fluid may be delivered at an elevated temperature, and may become viscous or sticky at cooler temperatures. As such, there is a need to maintain or heat up the treatment fluid within a range of temperatures, typically 50-80 degrees Celsius.

Chinese Utility Model No. 203420205 U ("the '205 publication") discloses a heating system for an emulsified asphalt tank rather than an emulsion fluid tank of a pre-coating tack. The system of the '205 patent includes a temperature switch that is associated with heating rods of the asphalt tank. The temperature switch is configured to independently control the start and stop of the heating rods and prevent local overheating.

The systems and methods of the present disclosure may address solve one or more of the problems set forth above and/or other problems in the art. The scope of the current disclosure, however, is defined by the attached claims, and not by the ability to solve any specific problem.

SUMMARY

According to the present disclosure, a paving machine includes an engine, a material conveying system, a screed system including a plurality of screed heaters, and an emulsion sprayer system. The emulsion sprayer system includes an emulsion tank and one or more emulsion heaters. The machine further includes an engine load sensing system and a control system. The control system being configured to receive information from the engine load sensing system indicative of a load on the engine, and limit the operation of the one or more emulsion heaters when the received information indicates the load on the engine is above a value.

According to another aspect of the present disclosure, a method of controlling a paving machine is disclosed. The machine includes an engine, a material conveying system, a screed system including a plurality of screed heaters, an emulsion sprayer system including an emulsion tank and one or more emulsion heaters, and an engine load sensing system. The method includes receiving information from the engine load sensing system indicative of a load on the engine, and limiting the operation of the one or more emulsion heaters when the received information indicates a load on the engine above a value.

According to yet another aspect of the present disclosure, a non-transitory computer-useable medium stores a program for controlling a paving machine, the program includes instructions for causing a computer to perform a method for controlling the paving machine. The method includes receiving information from an engine load sensing system of the paving machine, the received information being indicative of a load on an engine of the paving machine; and generating instructions for limiting the operation of one or more emulsion heaters of the paving machine when the received information indicates a load on the engine above a value.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. In this disclosure, relative terms, such as, for example, "about," "substantially," "generally," and "approximately" are used to indicate a possible variation of ±10% in the stated value. Although the current disclosure is described with reference to a paving machine, this is only exemplary. The present disclosure may be used with any road construction machine that uses an emulsion sprayer system.

Figure 1:
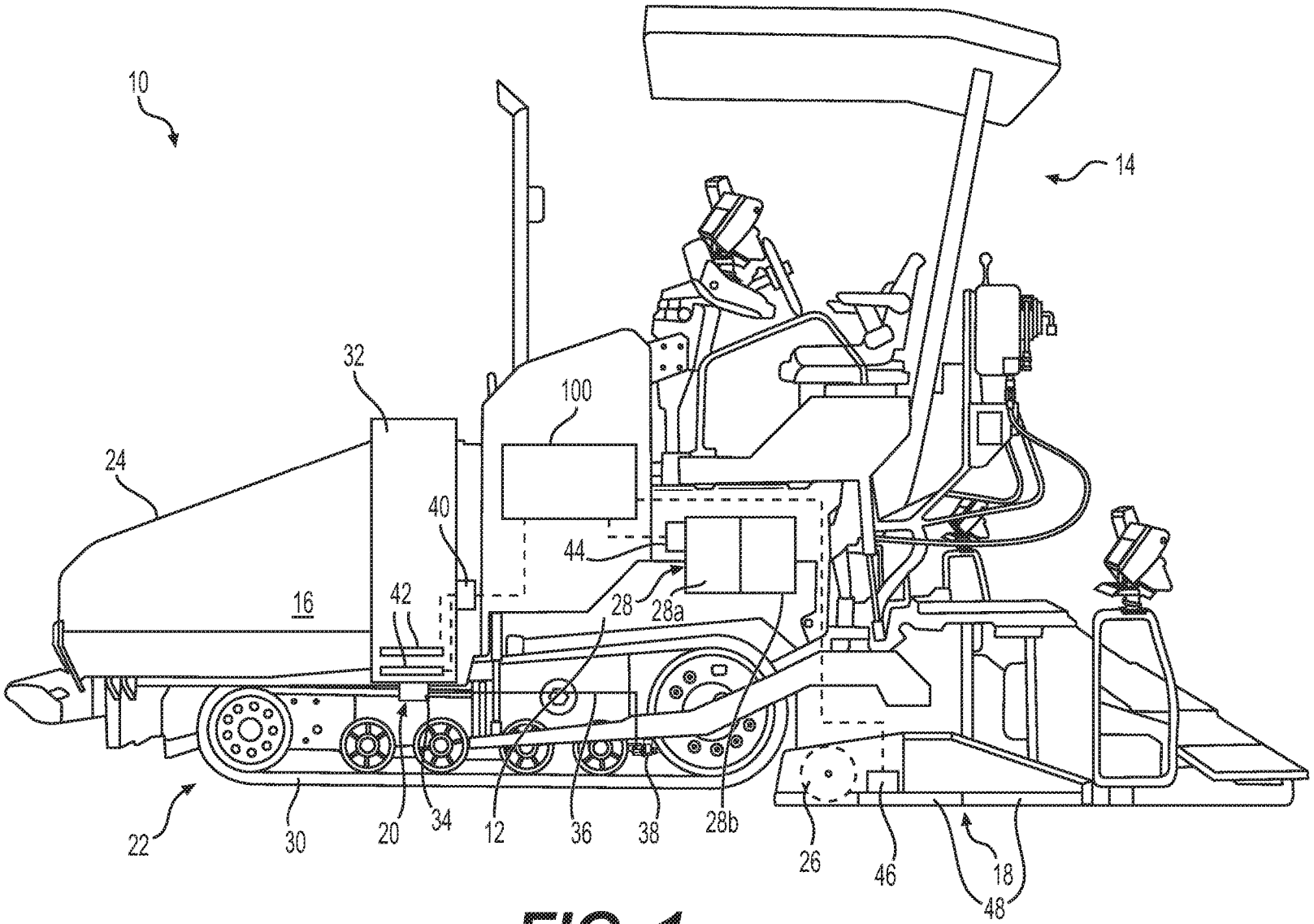
FIG. 1 is an illustration of a paving machine with an exemplary control system according to aspects of this disclosure.

FIG. 1 illustrates a side and partially schematic view of an exemplary paving machine 10, according to the present disclosure. Machine 10 may be any size paver with any paving width. Machine 10 includes a frame 12 for supporting an operator cab 14, material conveying system 16, screed system 18, emulsion sprayer system 20, propulsion system 22, and a machine controller 100. The material conveying system may include a hopper 24, a conveyor (not shown), and an auger 26. The propulsion system 22 may include, for example, an engine system 28, transmission and drivetrain components (not shown), and traction devices in the form of an endless track 30 on each side of the machine 10.

The emulsion sprayer system 20 is controlled to apply an emulsion, such as a liquid adhesion material, to the ground surface prior to applying the bitumen by the conveying system 16. The emulsion sprayer system 20 may include an emulsion tank 32, an emulsion pump 34, and emulsion conduits 36 for delivering emulsion to a plurality of spray bars 38 having nozzles thereon. The emulsion sprayer system 20 may include a sprayer system controller 40 and emulsion heaters 42 located in or on the emulsion tank 32 to maintain or heat up the emulsion within a desired temperature range to avoid high viscosity problems associated with lower temperature emulsion. The emulsion sprayer system 20 may include a plurality of emulsion heaters 42, for example, one, two, three, four, five, or six emulsion heaters that generate heat by resistive heating. Further, the emulsion sprayer system 20 may include an emulsion temperature sensor (not shown) that detects a temperature of the emulsion in the emulsion tank 32 and provides the temperature data to sprayer system controller 40.

Figure 2:
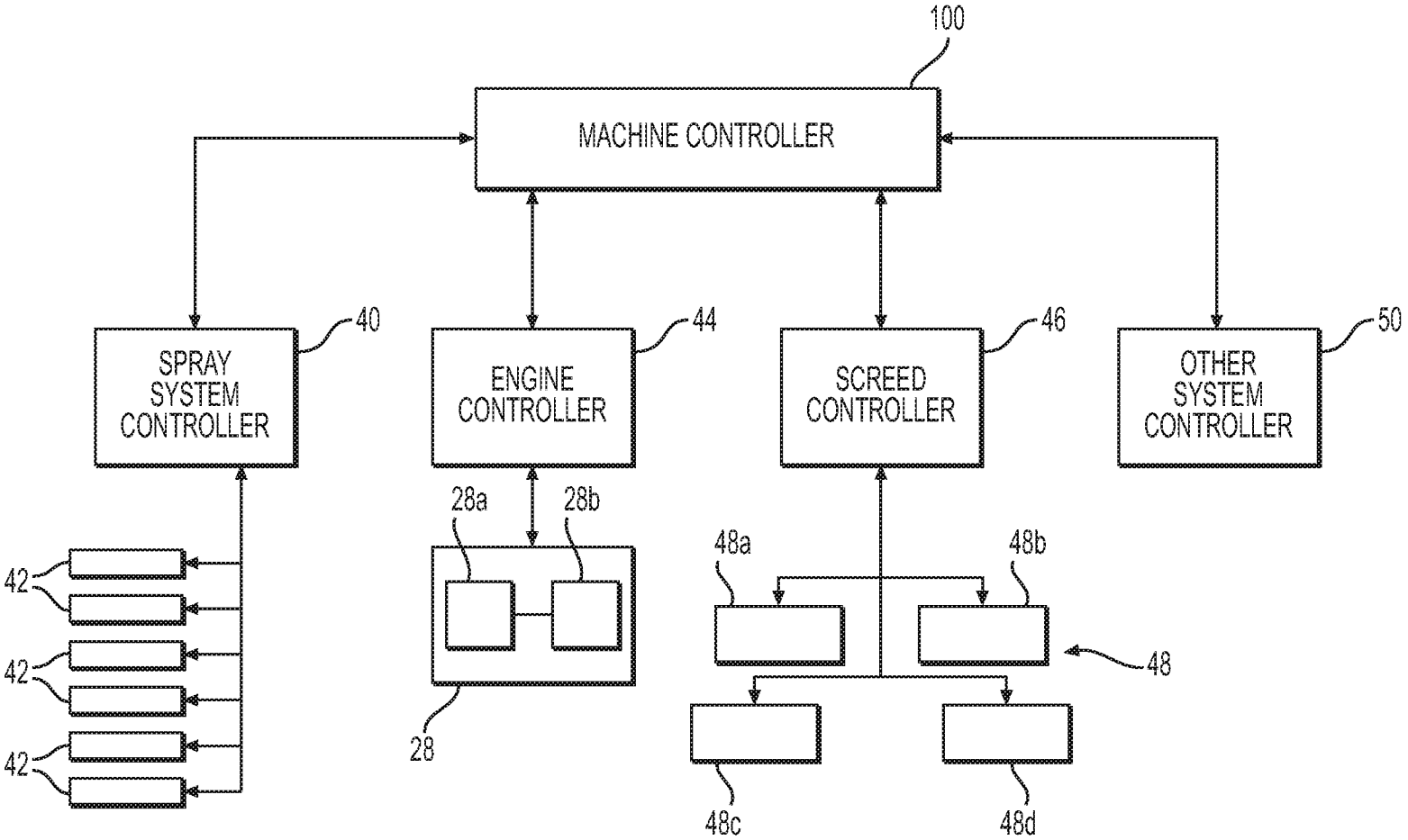
FIG. 2 is a schematic view of the control system of FIG. 1.

The screed system 18 is controlled to heat screed plates to prevent bitumen from sticking during the process of finishing the paving surface after the auger 26 applies the bitumen. The screed system 18 may include a screed controller 46 and a plurality of screed heaters 48. The plurality of screed heaters 48 may generate heat by resistive heating. As shown in FIG. 2, the plurality of screed heaters 48 may include two primary screed heaters 48*a* and 48*b* associated with two primary screed plates, and two extender screed heaters 48*c* and 48*d* associated with screed plates of two screed extenders. The plurality of screed heaters 48 may have screed temperature sensors (not shown) that measure the respective temperatures of the plurality of screed heaters 48 (or screed plates) and provide the temperature data to screed controller 46. As schematically shown in FIG. 2, the primary screed heaters 48*a* and 48*b* may be positioned with screed plates on left and right sides, respectively, of a central axis of the machine 10. The extender screed heaters 48*c* and 48*d* may similarly be positioned with screed plates on left and right sides, respectively, of the central axis of the machine 10 in a rearward direction from the primary screed heaters 48*a* and 48*b*. Further, the extender screed heaters 48*c* and 48*d* and associated screed plates may be movable, independently or coupled, along a transverse direction to the central axis of the machine 10, so as to be positioned behind the primary screed heaters 48*a* and 48*b* or moved outwardly from the central axis so as extend the range of ground covered in the transverse direction by the screed system 18.

Referring back to FIG. 1, the engine system 28 may generate mechanical and electrical power to operate various systems of the machine 10, such as the material conveying system 16, the screed system 18, the emulsion sprayer system 20, and the propulsion system 22. The engine system 28 may include an engine controller 44, an engine 28*a*, and a generator 28*b*. The engine 28*a* may generate the mechanical power, while the generator 28*b* may generate the electrical power. Generator 28*b* may provide the electrical power used by the emulsion heaters 42 and the plurality of screed heaters 48 to generate heat for the respective systems. Engine 28*a* may provide mechanical power to the generator 28*b* by means of a shaft or pulley coupling (not shown).

FIG. 2 provides further detail of the control system of FIG. 1. As discussed above, the machine 10 includes a control system that may include the machine controller 100, the sprayer system controller 40, the engine controller 44, the screed controller 46, and other system controller 50 (collectively "controllers"). The machine controller 100 may be communicatively coupled to each of the sprayer system controller 40, the engine controller 44, the screed controller 46, and the other system controller 50 to send and receive data. The controllers (40, 44, 46, 50) may be coupled to a shared data bus, and may communicate with engine controller 100 via a wired connection, wireless connection, and/or via any other communication connection.

The controllers (100, 40, 44, 46, 50) may transmit and receive information, instructions, and requests between each other. The machine controller 100 may receive information indicative of a load on the engine 28*a*. For instance, the machine controller 100 may receive information about an engine load factor from the engine controller 44. The engine load factor may be based on an actual fuel rate or fuel position, and may be calculated as a percentage by dividing actual fuel rate or fuel position by a maximum fuel rate or rated fuel limit. The machine controller 100 may also receive information from screed controller 46 regarding the operation of screed system 18, such as the temperature of the screeds and/or which screed heaters 48 are currently active. The machine controller 100 may also receive information from sprayer system controller 40 regarding the operation of sprayer system 20, such as the temperature of the emulsion fluid in the emulsion tank 32 and/or which emulsion heaters 42 are currently active. The machine controller 100 may receive information about mechanical and electrical loads drawn by other systems of the machine 10 from the other system controller 50, such as the material conveying system 16, the propulsion system 22, hydraulic systems (not shown), tamping systems (not shown), and/or vibration systems (not shown). While machine controller 100 is described herein as receiving, processing, and sending information to and from the other controllers (40, 44, 46, 50), it is understood that one or more of these functions of machine controller 100 could be performed by any of the other controllers (40, 44, 46, 50) or additional controllers, and that two or more of the controllers (100, 40, 44, 46, 50) could be combined in the same controller.

The controllers (100, 40, 44, 46, 50) may have a processor, a non-transitory computer readable medium ("memory") that stores instructions executable by the processor, and a communication interface to transmit and receive the information, instructions, and requests. The machine controller 100 may receive the above mentioned information and requests from the sprayer system controller 40, the engine controller 44, the screed controller 46, and the other system controller 50; process the information based on the stored instructions; and transmit instructions to the sprayer system controller 40, the engine controller 44, the screed controller 46, and the other system controller 50. The machine controller 100 may store all or portions of the received information for a set period of time in the memory or until the information is updated by changes in systems of the machine 10.

The machine controller 100 may transmit sprayer system instructions to the sprayer system controller 40. The sprayer system controller 40 may, based on the sprayer system instructions, control the emulsion heaters 42 and the emulsion pump 34. The sprayer system controller 40 may, based on the sprayer system instructions, control the emulsion heaters 42 to turn on or turn off. The sprayer system controller 40 may transmit information about a temperature of the emulsion or requests to the machine controller 100.

The machine controller 100 may also transmit screed instructions to the screed controller 44. The screed controller 46 may, based on the screed instructions, control individual screed heaters of the plurality of screed heaters 48 to turn on or turn off, or control combinations of the plurality of screed heaters 48 to turn on or turn off (e.g., control the primary screed heaters 48*a* and 48*b* to turn on or turn off separately or at the same time). The screed controller 46 may transmit information about temperature(s) of the screed heaters 48 or requests to the machine controller 100.

The machine controller 100 may further transmit engine instructions to the engine controller 44. The engine controller 44 may, based on the engine instructions, control the engine 28*a* and the generator 28*b*.

INDUSTRIAL APPLICABILITY

The disclosed aspects of machine 10 may be used in any temperature-controlled spraying system to help ensure that the heater(s) of the spraying system does not negatively affect paving performance or critical operations of the paving machine 10.

Figure 3:
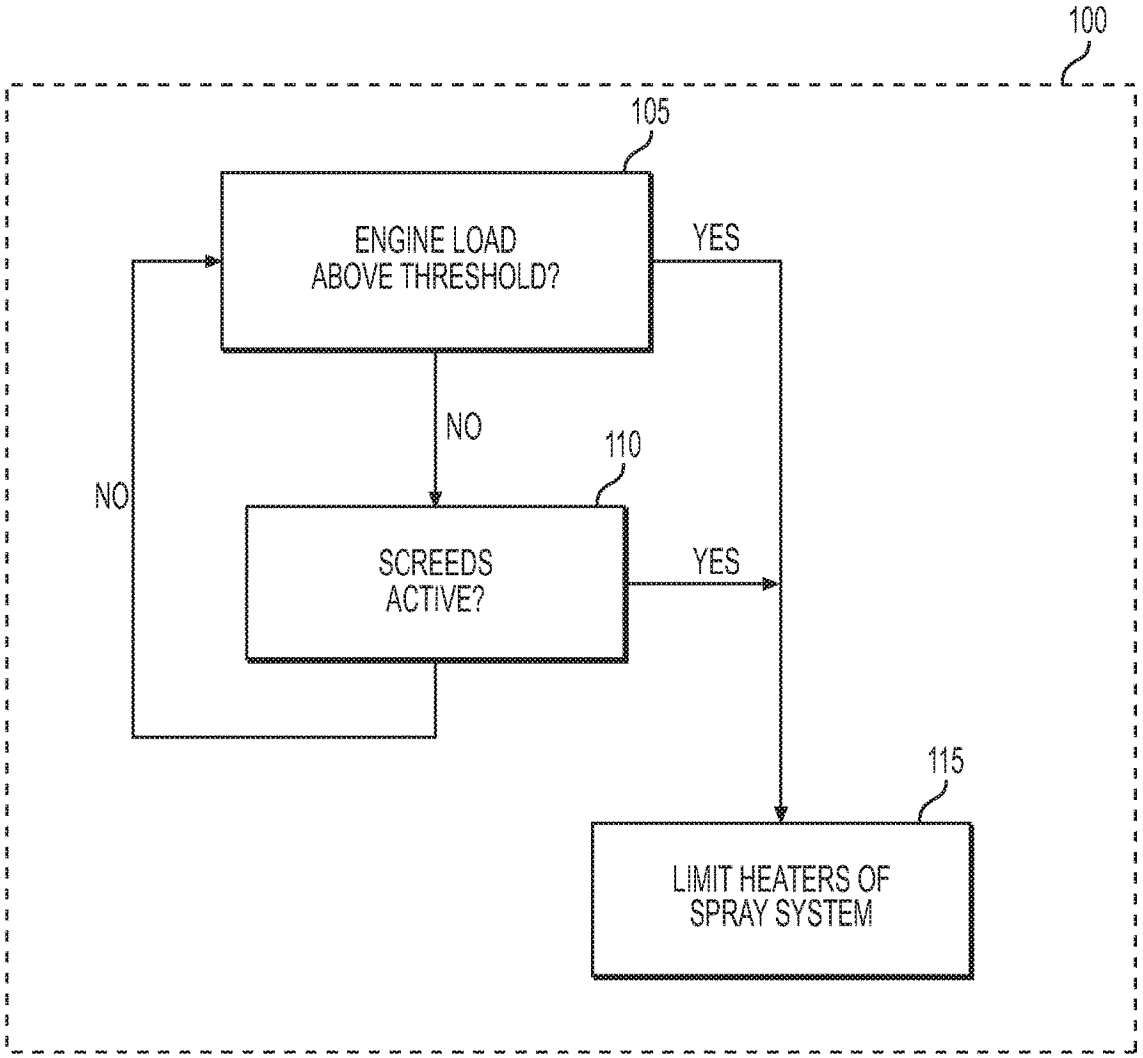
FIG. 3 provides a flowchart depicting an exemplary operation of the control system of FIGS. 1 and 2.

FIG. 3 provides a flowchart depicting an exemplary control strategy for the operation of machine 10. An initial step 105 includes determining whether the engine load is above a predetermined threshold. The load threshold may be based on any appropriate engine load measuring method. For example, the engine load threshold may be expressed as an engine load factor based on information received from engine controller 44. As noted above, the engine load factor may be based on an actual fuel rate or fuel position, and may be calculated as a percentage by dividing actual fuel rate or fuel position by a maximum fuel rate or rated fuel limit of the engine. In addition or alternatively, the engine load threshold may be based on engine torque and/or engine speed values. The load threshold may be a preset value stored in machine controller 100 and may be adjustable by an operator or service technician.

If it is determined that the engine load is not above the threshold (step 105: "NO"), the flow chart may advance to a step 110 that includes determining whether the screed heaters 48 of the screed system 18 are active. Whether the screed heaters 48 are active may be determined based on information from screed controller 46. If it is determined that no screed heater 48*a*-48*d* of the screed heaters 48 is active (step 110: "NO"), the flow chart may return to step 105, discussed above. If it is determined that at least one screed heater of the screed heaters 48 is active (step 110: "YES"), or if it is determined that the engine load is above the threshold (step 105: "YES"), the flow chart may advance to a step 115 that includes limiting the operation of the emulsion heaters 42 of the sprayer system 20. It is understood that the engine load above threshold query of step 105, and the active screed query of step 110 are both part of an engine load sensing system of machine controller 100, and that the information associated with these queries represents information indicative of a load on the engine system 28. Machine controller 100 may process additional queries and information indicative of the load on engine system 28. As will be discussed, when the information from the engine load sensing system indicates the load on the engine system 28 is above a value (e.g. engine load factor above a threshold, and/or a value corresponding to the number of active screed heaters 48), the operation of one or more of the emulsion heaters 42 would be limited (step 115).

Step 115 may include, for example, turning off all of the emulsion heaters 42 if the engine load is above a threshold (step 105: "YES"), or at least one screed heater 48*a*-48*c* of the screed heaters 48 is active (step 110: "YES"). In such an example, the emulsion heaters 42 would not be activated or reactivated until all of the active screed heaters 48 are no longer active (and vice versa), so that power draw from the respective systems do not overlap.

Alternatively, limiting the operation of the emulsion heaters 42 (via step 115) may be proportional to the engine load and/or the number of active screed heaters 48. Such a proportional response in step 115 may include sequentially turning off more emulsion heaters as the engine load increases through a plurality thresholds, and/or turning off more emulsion heaters 42 based on the number of active screed heaters 48. In one example, if the engine load is above the threshold (e.g., an 80% engine load factor as calculated above), then one, two, half (or some fraction), or all of the emulsion heaters 42 are turned off or not allowed to be activated. In another example, there may be a first threshold and a second threshold that is at a higher engine load than the first threshold, and as the engine load exceeds the first threshold a first set of emulsion heaters 42 (e.g., two of six) are turned off or not allowed to be activated, and as the engine load exceeds the second threshold a second set of emulsion heaters 42 (e.g., four of six, which may include or not include the first set of emulsion heaters 42) are turned off or not allowed to be activated.

An example of a proportional limiting of the emulsion heaters 42 in step 115 based on active screed heaters 48 may include disabling the number of active emulsion heaters 42 in a step-function manner based on the number of active screed heaters 48. For example, if zero, one, or two screed heaters 48 are active then only three of six emulsion heaters 42 may be allowed to be activated, and if three or four screed heaters 48 are active then one of six emulsion heaters 42 may be allowed to be activated. In another example, the number of emulsion heaters 42 that are allowed to be active out of all of the emulsion heaters 42 may be set as a function of an energy draw by the screed heaters 48. In this arrangement, the combined energy draw of the emulsion heaters 42 and screed heaters 48 would be maintained below a desired value.

In another example of limiting the emulsion heaters 42 (step 115), the emulsion heaters 42 may each be variably controlled from 0% to 100% power. Such variable control of the emulsion heaters 42 may allow for a more accurate balance of engine/screed load and the temperature of the emulsion in tank 32. For example, if the sum total of acceptable emulsion heater 42 power is less than 100% of one emulsion heater 42 based on the engine load, and/or the number of active screed heaters 48, the emulsion heater 42 may be activated, but limited to less than 100% power.

The limiting of the operation of the emulsion heaters 42 of step 115 may be configured to only occur during paving operations, and thus may be disengaged during non-paving operations when keeping the emulsion at a desired temperature may take precedence over certain non-paving operations. Further, the limiting of the emulsion heaters 42 of step 115 may be overridden if the temperature of the emulsion in emulsion tank 32 drop below a threshold temperature. In such a situation, engine load may be reduced by limiting other non-critical operations of the machine 10 that would not detrimentally affect the paving operation of the machine 10.

After limiting the operation of the emulsion heaters 42 (step 115), the engine load and active screeds may be monitored and one or more of the inactive emulsion heaters 42 may be turned back on when the engine load is sufficiently below the threshold and/or the number of active screeds 48 has been reduced.

Such an emulsion heating control of the present disclosure may assist in maintaining an effective paving operation of the machine during high engine load conditions. For example, the disclosed system may assist in avoiding an overloaded condition of engine system 28, wherein such a condition could result in shutting down the machine 10 or discontinuing systems of the machine 10 that would detrimentally affect the paving operation.

It will be apparent to those skilled in the art that various modifications and variations can be made to the disclosed machine without departing from the scope of the disclosure. For example, the control of FIG. 3 may include limiting the heaters of sprayer system 20 (step 115) only based on engine load (i.e., engine load factor) (step 105), or only based on the activation status of the screed heaters 42 (step 110). Other embodiments of the machine will be apparent to those skilled in the art from consideration of the specification and practice of the cleaning systems and methods for a spraying machine disclosed herein. It is intended that the specification and examples be considered as exemplary only, with a true scope of the disclosure being indicated by the following claims and their equivalents.

What is claimed is:

1. A paving machine, comprising:
an engine;
a material conveying system;
a screed system including a plurality of screed heaters;
an emulsion sprayer system, the emulsion sprayer system including
an emulsion tank, and
one or more emulsion heaters
an engine load sensing system; and
a control system configured to:
receive information from the engine load sensing system to determine a load on the engine the received information includes a number of the plurality of screed heaters that are active and a number of the one or more emulsion heaters that are active, and
limit the operation of the one or more emulsion heaters or the number of the plurality of screed heaters that are active when the received information indicates the load on the engine is above a value.

2. The paving machine of claim 1, wherein the received information is used to determine an engine load factor, and the limiting of the operation of the one or more emulsion heaters is triggered when the engine load factor is above the value.

3. The paving machine of claim 2, wherein the engine load factor is based at least on engine fueling data.

4. The paving machine of claim 1, wherein the received information includes information indicative of a power consumption of the screed system.

5. The paving machine of claim 4, wherein the information indicative of the power consumption of the screed system includes the number of the plurality of screed heaters that are active.

6. The paving machine of claim 5, wherein the limiting of the operation of the one or more emulsion heaters includes turning at least one of the one or more emulsion heaters off if at least one of the plurality of screed heaters are active.

7. The paving machine of claim 1, wherein the one or more emulsion heaters includes a plurality of emulsion heaters, and the limiting of the operation of the one or more emulsion heaters includes turning one or more active emulsion heaters off.

8. The paving machine of claim 7, wherein the limiting of the operation of the one or more emulsion heaters includes turning all active emulsion heaters off if at least one of the plurality of screed heaters are active.

9. The paving machine of claim 1, wherein the limiting of the operation of the one or more emulsion heaters only takes place during a paving operation.

10. The paving machine of claim 1, wherein the received information is used to determine an engine load factor, and the limiting of the operation of the one or more emulsion heaters is triggered when the engine load factor is above the value, and
the received information includes the number of the plurality of screed heaters that are active, and the limiting of the operation of the one or more emulsion heaters also includes turning at least one of the one or more emulsion heaters off if at least one of the plurality of screed heaters are active.

11. A method of controlling a paving machine, the paving machine including an engine, a material conveying system, a screed system including a plurality of screed heaters, an emulsion sprayer system including an emulsion tank and one or more emulsion heaters, and an engine load sensing system, the method comprising:
receiving information from the engine load sensing system indicative of a load on the engine, the information includes information indicative of a power consumption of the screed system based on a number of screed heaters that are active, and
limiting the operation of the one or more emulsion heaters, the limiting operation includes turning at least one of the one or more emulsion heaters off if at least one of the screed heaters are active when the received information indicates a load on the engine above a value.

12. The method of controlling the paving machine of claim 11, wherein the received information is used to determine an engine load factor, and the limiting of the operation of the one or more emulsion heaters is triggered when the engine load factor is above the value.

13. The method of controlling the paving machine of claim 12, wherein the engine load factor is based at least on engine fueling data.

14. A non-transitory computer-useable medium storing a program for controlling a paving machine, the program comprising instructions for causing a computer to perform a method for controlling the paving machine, the method comprising:
receiving information from an engine load sensing system of the paving machine, the received information being indicative of a load on an engine of the paving machine, and
generating instructions for limiting the operation of one or more emulsion heaters, includes turning at least one of the one or more emulsion heaters off if at least one of the screed heaters are active of the paving machine when the received information indicates a load on the engine above a value.

15. The non-transitory computer-useable medium of claim 14, wherein the received information is used to determine an engine load factor, and the generating the instructions for limiting the operation of the one or more emulsion heaters is triggered when the engine load factor is above the value.

16. The non-transitory computer-useable medium of claim 14, wherein the received information includes information indicative of a power consumption of a screed system of the paving machine, and the information indicative of the power consumption of the screed system includes a number of screed heaters that are active.

* * * * *